US007940227B2

(12) United States Patent
Chou

(10) Patent No.: US 7,940,227 B2
(45) Date of Patent: May 10, 2011

(54) PASSIVE WIRELESS TRANSMIT AND RECEIVE TERMINATOR

(75) Inventor: Jui-Yu Chou, Tainan (TW)

(73) Assignee: ZyXEL communications Corp., Hsinchu Science Park, Hsinchu (TW)

( * ) Notice: Subject to any disclaimer, the term of this patent is extended or adjusted under 35 U.S.C. 154(b) by 327 days.

(21) Appl. No.: 12/346,848

(22) Filed: Dec. 31, 2008

(65) Prior Publication Data

US 2010/0164810 A1 Jul. 1, 2010

(51) Int. Cl.
*H01Q 21/26* (2006.01)

(52) U.S. Cl. ..... 343/797; 343/795

(58) Field of Classification Search ..... 343/795, 343/797, 810

See application file for complete search history.

(56) References Cited

U.S. PATENT DOCUMENTS

| | | | | |
|---|---|---|---|---|
| 4,686,536 | A * | 8/1987 | Allcock | 343/700 MS |
| 6,329,954 | B1 * | 12/2001 | Fuchs et al. | 343/725 |
| 7,616,168 | B2 * | 11/2009 | Tillery | 343/797 |
| 7,868,842 | B2 * | 1/2011 | Chair | 343/797 |
| 2007/0008236 | A1 * | 1/2007 | Tillery et al. | 343/797 |

* cited by examiner

*Primary Examiner* — Tan Ho

(74) *Attorney, Agent, or Firm* — Winston Hsu; Scott Margo

(57) ABSTRACT

A MIMO passive wireless transmit and receive terminator system includes a base for providing a signal source and two terminators fixed substantially perpendicular to the base and parallel with each other. Each terminator includes four radiating fins spaced at approximately 90 degree intervals and has radiator plates located near the top and bottom of an outer edge of each radiating fin, a central, non-radiating portion of the outer edge separating the top and bottom radiating plates from each other and from a central metallic layer. A control circuit may be disposed within the base or the metallic layer for selectively supplying the signal source to the radiating plates of only one of the radiating fins of each terminator.

10 Claims, 4 Drawing Sheets

Top view

Top View

PASSIVE WIRELESS TRANSMIT AND RECEIVE TERMINATOR

BACKGROUND OF THE INVENTION

1. Field of the Invention

The current disclosure relates to a passive wireless transmit and receive terminator, more specifically a four side multiple-input multiple-output passive wireless transmit and receive terminator used in customer premises equipment.

2. Description of the Prior Art

A multiple-input multiple-output (MIMO) passive wireless transmit and receive terminator is a form of smart antenna technology that uses multiple terminators at both the transmission and reception ends. MIMO terminators exhibit greater link reliability while significantly increasing data throughput when compared with conventional antennas. Thus, MIMO terminators are becoming increasingly important in wireless communications with continuing room for improvement in reliability, size, cost, and ease of manufacture.

SUMMARY OF THE INVENTION

A four side multiple-input multiple-output passive wireless transmit and receive terminator comprises a base for providing a signal source and two terminators fixed substantially perpendicular to the base and extending parallel with each other. Each terminator includes four radiating fins spaced at approximately 90 degree intervals and has radiating plates located at the top and bottom of an outer edge of both sides of each radiating fin, a central, non-radiating portion of the outer edge separating the top and bottom radiating plates. A central metallic layer substantially encloses the intersection of the radiating fins while the radiating fins extend perpendicularly outward relative each other. A control circuit may be disposed on the metallic surfaces for selectively supplying the signal source to the radiating plates of only one of the radiating fins of each terminator.

A method of constructing a four side multiple-input multiple-output passive wireless transmit and receive terminator comprises providing a base for supplying a signal source. Interconnection slots are formed at opposite sends of each of two sheets of double sided PCB. Radiating plates are formed on portions of each end of two longest edges of each side of the two sheets with each of the radiating plates electrically coupled to corresponding wires or traces leading to the signal source. A non-radiating section is formed in a central portion of the two longest edges of each of the two sheets. The two sheets are interconnected such that the two sheets are perpendicular and an intersection of the two sheets bisects each of the two sheets. A metallic layer covers portions of the two sheets nearest the intersection of the two sheets such that a non-radiating section of the two sheets is formed between the radiating plates and the metallic layer to form a first terminator. A second terminator is formed identical to the first terminator and the first and second terminators are fixed to the base such that the intersections of the two sheets of each terminator is substantially perpendicular to a surface of the base, coupling the wires to the source signal.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
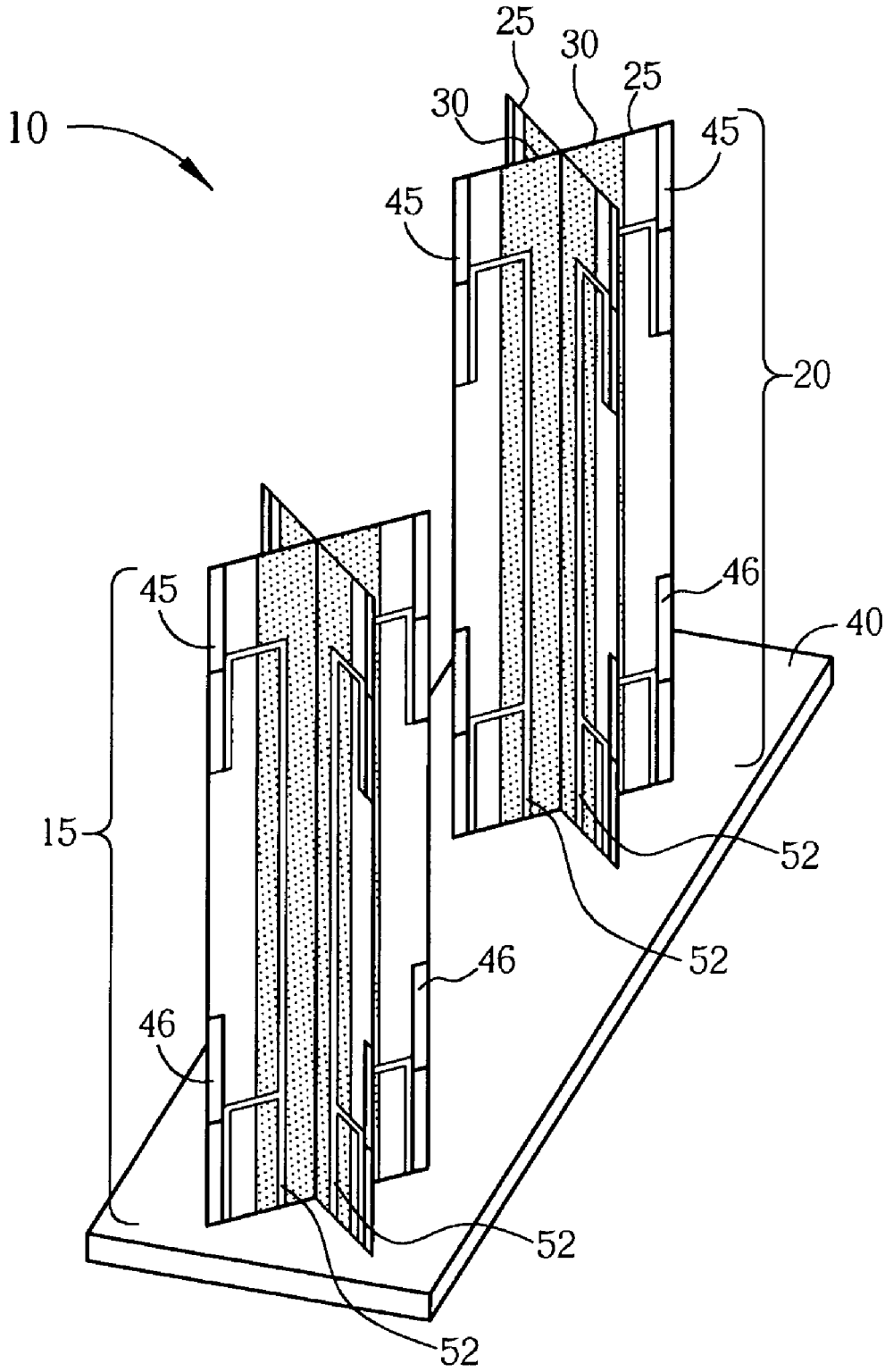
FIG. 1 is four side MIMO passive wireless transmit and receive terminator according to an embodiment of the present invention.

Please refer to FIG. 1, which illustrates a four side multiple-input multiple-output passive wireless transmit and receive terminator 10 according to an embodiment of the present invention. The terminator 10 comprises two substantially identical side four side MIMO passive wireless transmit and receive terminators 15 and 20, each having an end preferably fixed to a base 40 such that a longest length of each of each terminator 15 and 20 is substantially perpendicular to the base and parallel to each other.

Each terminator 15 and 20 comprises four radiating fins 25 preferably running the longest length of the respective terminator and spaced at approximately 90 degree intervals relative to each other when viewed from above. The radiating fins 25 preferably also make an angle with an imaginary line connecting the centers of the two terminators 15 and 20 that is about 45 degrees plus a non-zero integer multiple of 90 degrees, although this feature is not limiting. The four radiating fins 25 of each terminator 15 and 20 form two pairs of substantially parallel radiating surfaces that extend in opposite directions relative to the center of the respective terminator 15 and 20. Each of the pairs of substantially parallel radiating surfaces may be formed out of a single sheet of a planar material, such as a double sided PCB in one embodiment, and the two sheets of a planar material of may be fitted together by interlocking slots (FIGS. 3, 59, 61) formed partway along the longest length of each sheet to form the four radiating fins 25.

Each of the radiating fins 25 comprises at least four radiator plates 45 and 46, possibly printed metal, located near the top and bottom of the outer edge on each side of the radiating fin 25 relative to the center of the terminator 15 and 20. The adjacent pairs of radiating plates 45 (and 46) on opposite sides of each radiating fin 25 in some embodiments may be offset from each other relative to the longest length of the radiating fins 25 to provide better transmission/reception characteristics. Some embodiments may comprise additional radiator plates 45 and 46, of differing sizes and/or shapes to enable better transmission/reception characteristics in multi-band environments. However regardless of the number of radiating plates 45 and 46 employed, embodiments where a central, non-radiating portion of each outer edge separates the top and bottom radiating plates 45 and 46 and a simple power sharing scheme between radiating plates 45 and 46 may give the best results due to effective use of dipole characteristics. Additionally, the top radiating plate 45 acting as an additional reflector for the bottom radiating plate 46 and vice versa further increases effectiveness of the design. The radiating fins 25 each comprise a plurality of wires, printed traces, or other electrically conducting pathways 52 comparable to the number of radiating plates 45 and 46 enabling feed and possibly ground connections to be easily formed with the signal source. It may be possible to form the two adjacent radiating plates 45 (or 46), one located on each side of the radiating fin 25, out of a single piece of foil or metal folded around the edge of the radiating fin 25.

A metallic layer 30 runs substantially the longest length of the central portion of each side of each sheet of planar material. A non-radiating portion of each fin 25 separates the top and bottom radiating plates 45, 46 from each other and from the metallic layer 30. A control circuit may be disposed within the metallic layer 30 or within the base according to different embodiments for selectively supplying the signal source to the radiating plates of only one of the radiating fins. The wires 52 may be considered the control circuit in some embodiments. The metallic layers 30 of radiating fins 25 form a perpendicular structural arrangement maximizing reflectivity of signals transmitted from the neighboring radiating plates 45 and 46.

Preferred embodiments include at least a control circuit comprising a switch disposed on the metallic layer 30 or alternatively within the base 40, allowing simple selective attachments to feed and ground connections 52 found on the radiating fins 25 as previously described. The control circuit 42 possibly also includes a microprocessor and/or memory. Such control circuit optionally may measure signal strength and store associated data within the memory, controlling the terminators 15, 20 accordingly. Some additional RF circuitry may also be located within the metallic layer 30 or the base 40 in some embodiments but the signal source preferably is located within the base 40 to facilitate both terminators 15 and 20 sending and receiving the same signal.

Figure 2:
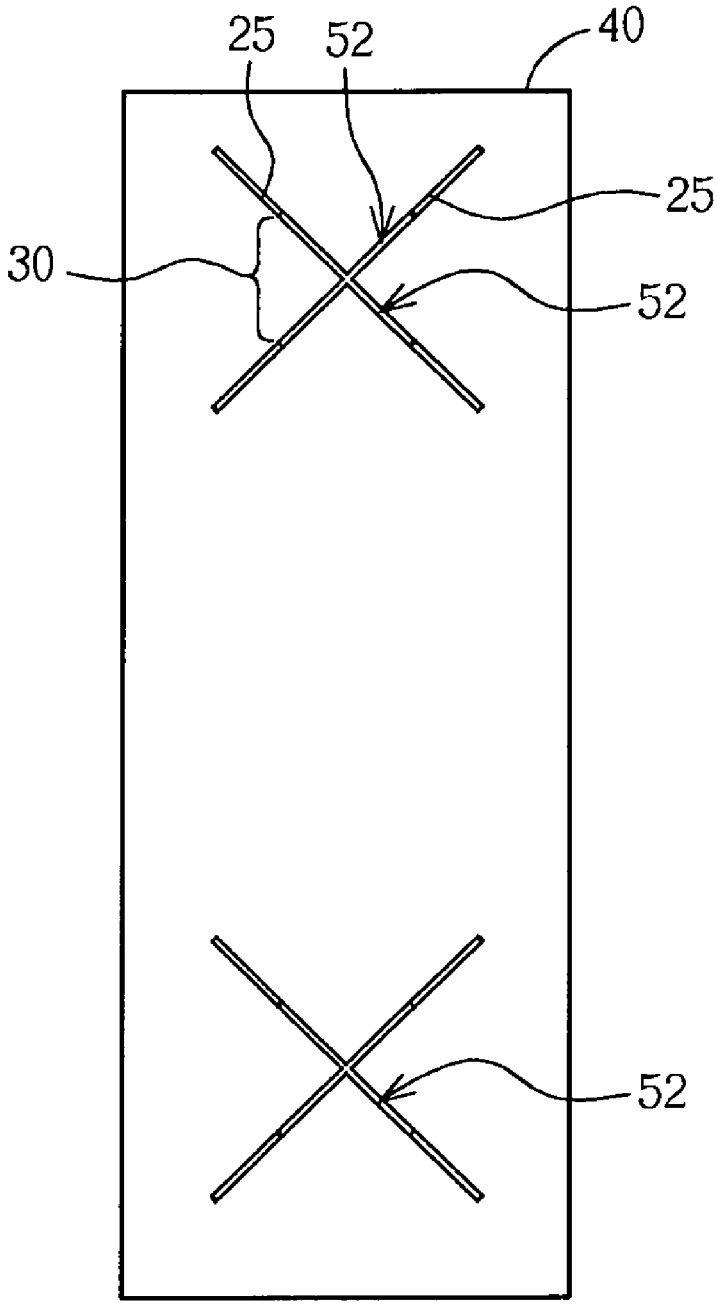
FIG. 2 is a top view of the terminator of FIG. 1.

FIG. 2 shows a top view of the MIMO terminator 10, illustrating approximate relative positions and orientations of the base 40, the radiating fins 25, the metallic layers 30, and the connecting wires 52.

Figure 3:
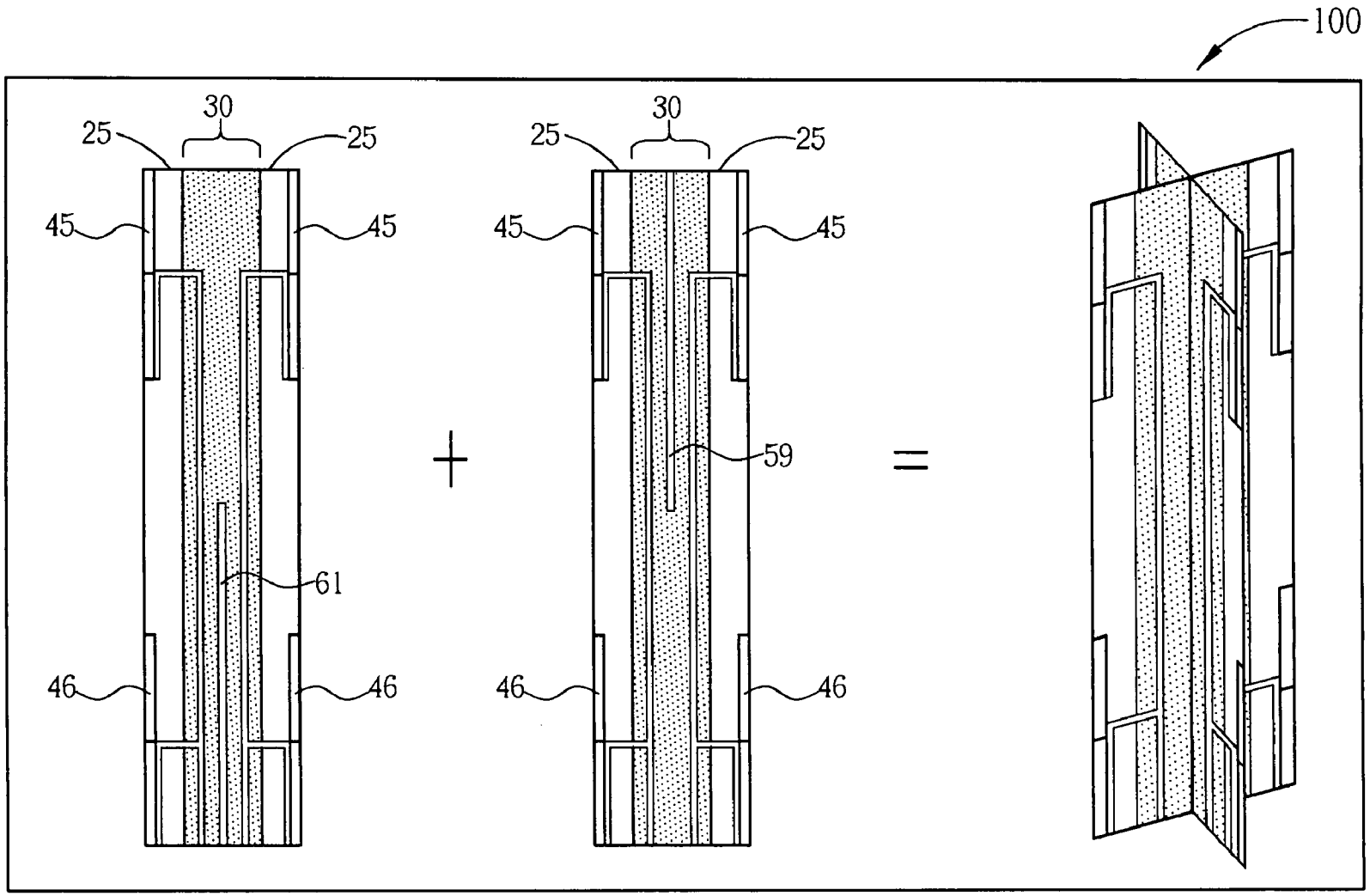
FIG. 3 shows construction of the terminator of FIG. 1 according to one embodiment.

Please refer now to FIG. 3, which shows a method of constructing an embodiment of the MIMO terminator 100 according to the present invention. The metallic layer 30, the wires 52, and the radiating plates 45, 46 are formed on each side of two sheets of a planar material, such as double sided PCB, and a slot 59, 61 is formed bisecting at least part of the longest length of each sheet. Additional control circuitry may also be formed on the metal layers 30 in some embodiments. The two sheets are then fitted together such that the two sheets are perpendicular to each other forming a first terminator as is shown in FIG. 3. A second terminator substantially identical to the first terminator is formed and the first and second terminators are fixed to the base 40 such that the intersections of the two sheets of each terminator is substantially perpendicular to the surface of the base coupling the radiating plates 45, 46 via the wires 52 and/or control circuit to the source signal.

Figure 4:
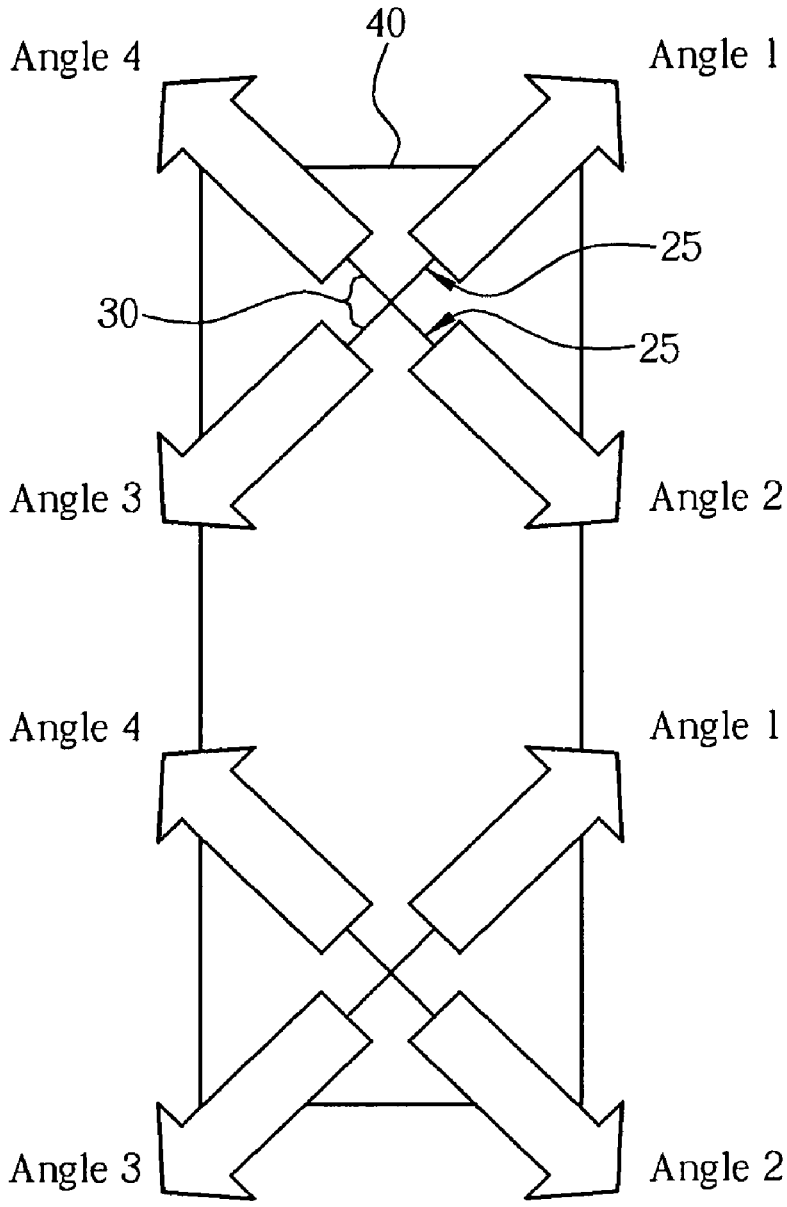
FIG. 4 illustrates operation of the terminator of FIG. 1.

Please refer now to FIG. 4, which illustrates the MIMO terminator 10, 100 in operation. The MIMO terminator 10, 100 is operated so that radiating plates 45 and 46 of both a first radiating fin 25 of the terminator 15 and a first radiating fin 25 of the terminator 20 may be substantially simultaneously switched to actively receive power and signal. Because the first radiating fin 25 of the terminator 15 and the first radiating fin 25 of the terminator 20 extend in the same direction relative to the center of the respective terminators 15 and 20, combined with signal reflections off of the surface of the metal layers 30 on the nearest the active fins, the terminator 10 becomes a highly directionalized terminator in the same direction as the active fins 25 extend (Angle 1). Signal strength in this direction may be measured and stored. Next, the first radiating fins 25 may become electrically disconnected from power and signal, and a second radiating fin 25 of the terminator 15 and a second radiating fin 25 of the terminator 20 may actively receive power and signal, forming a directionalized terminator 10 sending and/or receiving in the direction that the second radiating fins 25 parallelly extend (Angle 2). Again signal strength may be measured and stored, and the process may be repeated for each of the third (Angle 3) and fourth (Angle 4) pairs of parallel radiating fins 25.

When signal strength in all four directions is measured, a comparison may be made and the direction having the strongest signal strength is chosen for transmission and reception, causing the connection of power and signal only to the radiating plates 45 and 46 of the radiating fins 25 extending in the chosen direction. Re-measurements of signal strengths and possible resulting readjustment of the chosen active direction may occur periodically or as needed due to lowering signal strength or other design considerations.

Embodiments of a four side multiple-input multiple-output passive wireless transmit and receive terminator according to the present invention provide advantages over conventional antennas of improving link reliability and increasing data throughput due to their selective directional characteristics. The specific structures disclosed herein reduce size by efficient placement of control circuits, reduce costs by simplifying construction, and further improve RF characteristics of the terminator through the use of power sharing and multiple radiating plates on each radiating fin. The rectangular reflective metal layers, high frequency signal feed-in network, and dipole antenna array are disposed on each side of the same double layer PCB, thus has low cost and can be made easily. Using the perpendicular dipole antenna array to implement high radiation power maintains a large radiation wave width at the horizontal angle.

Those skilled in the art will readily observe that numerous modifications and alterations of the device and method may be made while retaining the teachings of the invention.

What is claimed is:

1. A MIMO terminator system comprising:

a base for providing a signal source; and two terminators fixed to the base such that a longest length of each of each terminator is substantially perpendicular to the base and parallel with each other, each terminator comprising:

four radiating fins running the longest length of the terminator and spaced at approximately 90 degree intervals relative to each other, each radiating fin comprising a metallic layer substantially running the longest length of each terminator along an intersection of the radiating fins and radiator plates located at the top and bottom of an outer edge of the radiating fin, a non-radiating portion of each fin separating the top and bottom radiating plates from each other and from the metallic layer; and a control circuit disposed within the metallic layer for selectively supplying the signal source to the radiating plates of only one of the radiating fins;

wherein the radiating fin of each terminator comprising the radiating plates supplied the signal source are substantially parallel and extend in substantially the same direction.

2. The terminator system of claim 1 wherein the control circuit comprises a switch for selecting the radiating fin supplied the signal source.

3. The terminator system of claim 2 wherein the control circuit further comprises a microprocessor coupled to the switch and to a memory.

4. The terminator system of claim 2 wherein for each terminator, the four radiating fins form two substantially perpendicular pairs of parallel surfaces, each pair formed out of single sheet of planar material.

5. The terminator system of claim 4 wherein the planar material is PCB.

6. The terminator system of claim 4 wherein two sheets of the planar material form the four radiating fins of each terminator, and the two sheets are fitted together by interlocking slots formed partway along the longest length of each sheet to form the four radiating fins.

7. The terminator system of claim 1 wherein the radiating fins make an angle that is about 45 degrees plus a non-zero integer multiple of 90 degrees with an imaginary line connecting the centers of the two terminators.

8. A method of MIMO terminator construction comprising:

providing a base for supplying a signal source;

forming a metallic layer on a central portion of both sides of each of two sheets of PCB;

forming a control circuit in the metallic layer on at least one of the two sheets of PCB;

forming radiating plates on portions of each end of two longest edges of each of the two sheets and a non-radiating central portion separating the radiating plates from each other and from the metallic layer;

interconnecting the two sheets such that the two sheets are substantially perpendicular and an intersection of the two sheets substantially bisects each of the two sheets along the longest length;

forming a first terminator substantially identical to a second terminator; and fixing the first and second terminators to the base such that the intersections of the two sheets of each terminator are substantially perpendicular to a surface of the base coupling the control circuit to the source signal.

9. The method of claim 8 wherein forming the control circuit comprises forming wires respectively coupled to each of the radiating plates for coupling only selected radiating plates to the source signal.

10. The method of claim 9 wherein forming the control circuit comprises forming a switch coupled to each of the radiating plates for coupling only selected radiating plates to the source signal.

* * * * *